United States Patent [19]

Imperial et al.

[11] 3,987,588

[45] Oct. 26, 1976

[54] METAL DOOR ASSEMBLY AND METHOD OF PRODUCTION

[75] Inventors: Raymond E. Imperial; Edward G. Schultz, Jr.; George Scott Hull, all of Richmond, Ind.

[73] Assignee: Johnson Sheet Metal Works Corporation, Richmond, Ind.

[22] Filed: Apr. 3, 1975

[21] Appl. No.: 564,826

Related U.S. Application Data

[63] Continuation-in-part of Ser. No. 416,883, Nov. 19, 1973, Pat. No. 3,885,351.

[52] U.S. Cl. ..... 49/501; 52/620; 52/624

[51] Int. Cl.[2] ..... E06B 3/16; E04C 2/34

[58] Field of Search ..... 49/501, 503, 468, 470, 49/DIG. 1, DIG. 2, 482; 52/615, 619, 620, 624, 623

[56] References Cited

UNITED STATES PATENTS

| | | | |
|---|---|---|---|
| 1,452,703 | 4/1923 | Pollard | 49/499 X |
| 3,153,817 | 10/1964 | Pease, Jr. | 52/619 |
| 3,310,920 | 3/1967 | Bell et al. | 49/501 X |
| 3,334,464 | 8/1967 | Charles | 49/501 X |
| 3,402,520 | 9/1968 | Lee et al. | 52/615 X |
| 3,512,305 | 5/1970 | Multer | 49/503 |
| 3,604,152 | 9/1971 | Protzman | 49/470 |
| 3,750,333 | 8/1973 | Vance | 49/501 |
| 3,786,609 | 1/1974 | DiFazio | 52/619 |

*Primary Examiner*—Philip C. Kannan
*Attorney, Agent, or Firm*—Jacox & Meckstroth

[57] ABSTRACT

A formed sheet metal rectangular-shaped frame is positioned between two sheet metal side panels which may be embossed to provide the appearance of small wood panels. The frame includes an elongated frame member for each edge of the door, and each frame member has two outwardly facing parallel spaced channel portions integrally connected by a center web portion. Extruded plastic trim members cover the top and side frame members and include longitudinally extending hook-shaped leg portions which project into the channel portions and snap-fit onto inwardly formed edge portions of the side panels. A foam insulation material is expanded between the side panels and also serves to space the side panels laterally from the frame to form a thermal barrier. The side trim members are interrupted or notched to receive the door hinges and a latch bolt housing which seat on the web portions of the corresponding frame members. A generally U-shaped elongated door seal is secured to the frame member which extends along the bottom of the door. The frame is preferably constructed in two opposing generally C-shaped sections which are expanded to receive the edge portions of the side panels before the foam is inserted, and a block of more dense insulation material is placed between the side panels adjacent one of the frame sections for attaching a door lock set.

17 Claims, 15 Drawing Figures

METAL DOOR ASSEMBLY AND METHOD OF PRODUCTION

RELATED APPLICATION

This application is a continuation-in-part of U.S. application Ser. No. 416,883, filed Nov. 19, 1973, now issued as U.S. Pat. No. 3,885,351.

BACKGROUND OF THE INVENTION

In the construction of metal doors such as, for example, the doors disclosed in U.S. Pat. Nos. 2,297,609, 3,153,817, 3,273,287, 3,333,385, 3,455,078 and 3,750,333, it has been found desirable to provide for a thermal barrier between the sheet metal skins or side panels of the door in addition to providing for a door which is rigid and will remain flat and not warp with changes in temperature and humidity. It is also desirable for a metal door to be constructed so that the hinges may be mounted on either door edge and in a recessed manner so that the hinges are flush with the outer edge surface of the door.

Similarly, it is desirable to provide for mounting the lock or latch bolt on either side of the door for making the door reversible and to position the mounting flange for the bolt housing so that the flange is flush with the corresponding edge surface of the door. In addition to the above features, it is sometimes desirable for the metal door to include an adjustable threshold sealing member along the bottom of the door and to provide for quick and simplified assembly and installation.

SUMMARY OF THE INVENTION

The present invention is directed to an improved metal door assembly which provides all of the desirable features mentioned above and, in addition, provides for using sheet metal side panels each of which may be drawn to form a series of rectangular impressions for producing the appearance of a conventional wood panel door construction. In the illustrated embodiments of the invention, the door assembly is constructed without any wood and includes a metal frame. The frame is formed by roll forming a metal strip to produce a pair of parallel spaced U-shaped channel portions which are integrally connected by a center web portion. The metal frame extends long each edge of the door, and the channel portions of the frame receive inwardly projecting edge portions of the sheet metal side panels.

An expanded plastics foam insulation material fills the cavity defined between the side panels and also extends into narrow spaces defined between the side panels and the metal frame to form a thermal barrier. Extruded plastics trim members cover the channel portions of the frame members extending along the vertical edges and top of the door. Each trim member includes integral hook-shaped longitudinally extending leg portions which project into the channel portions of the frame and snap-fit onto the inwardly formed edge portion of the side panels. The trim members are notched or interrupted to receive the hinges and a door latch bolt assembly, and an extruded plastics door sweep or seal with flexible sealing lips, is adjustably connected to the metal frame member along the bottom of the door.

In the preferred embodiment, the frame is formed in two mating generally C-shaped sections which are expanded between the side panels into engagement with the edge portions of the side panels. In addition, a block of rigid expanded foam material is positioned between the side panels adjacent one of the frame sections and has integral rib portions which project into corresponding slots within the adjacent frame member for mounting a door lock set.

BRIEF DESCRIPTION OF THE DRAWING

FIG. 2 is a view similar to FIG. 11 and showing the arrangement of the frame sections before being expanded into the position shown in FIG. 11;

DESCRIPTION OF THE PREFERRED EMBODIMENT

Figure 1:
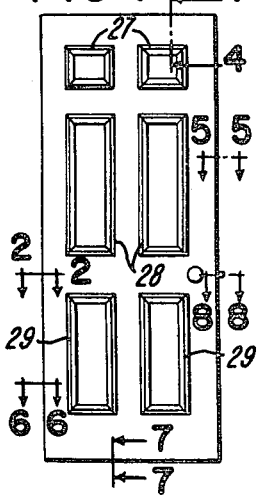
FIG. 1 is an elevational side view of a metal door constructed in accordance with the present invention.

The sheet metal door assembly illustrated in FIG. 1 includes a rectangular-shaped metal frame formed by an elongated frame member 10 extending along each edge of the door. The frame members are constructed by roll forming a sheet metal strip, and each frame member includes a pair of parallel spaced U-shaped channel portions 12 integrally connected by a flat center web portion 14. The outer longitudinal edges of the channel portions 12 are formed inwardly to produce opposing lip portions 16 which are located slightly inwardly from the web portion 14. The rectangular frame is formed by notching and bending the roll-formed strip for three of the corners of the door, and the adjacent miltered ends 17 (FIG. 3) of the strip are joined together at the fourth upper corner of the door by a formed sheet metal angle bracket 18 and a set of "Pop" rivets 19.

A pair of opposing rectangular side panels 25 are formed of sheet metal and are preferably either finish-coated with a baked-on-enamel or epoxy paint or are precoated with a durable plastics material. The side panels 25 are stamped or drawn to form a series of rectangular frame-like recesses or impressions 27, 28 and 29 to provide each panel 25 with the appearance of a paneled wood door. However, it is to be understood that the recesses or impressions 27–29 may be omitted for flush door assemblies.

The top and longitudinal edge portions of each side panel 25 are formed inwardly by two right angles to produce a corresponding flange portion 31 and another flange or tab portion 32. The tab portions 32 may be continuous along the side and top edges of each side panel 25 or may be interrupted to form a series of spaced tabs. As shown in FIGS. 2–8, the tab portions 32 of each side panel 25 contact or engage the ends of the adjacent lip portions 16 of the frame members 10 and project inwardly into the cavities defined by the channel portions 12 of the frame 10.

The bottom edge portion of each side panel 25 is secured to the bottom frame member 10 by a double-sided adhesive tape 34 having a thickness of about 1/16 inch. The width of the flange portions 31 of each side panel 25 is somewhat greater than the width of the lip portions 16 of the frame members 10 to form a narrow slot-like space 36 between each of the side panels 25 and the frame members 10 around the periphery of the frame. The outer surface of each flange portion 31 of each side panel 25, is positioned flush with the outer surface of the web portion 14 of the corresponding frame member 10, as illustrated in FIGS. 5–8.

An expanded froth-type polymeric foam insulation material 38 fills the entire cavity defined within the metal frame members 10 between the side panels 25 and extends outwardly into the space between the channel portions 12 of the frame members 10 and the narrow spaces 36 defined between the frame members 10 and side panels 25. Preferably, the insulation material 38 consists of a rigid polyurethane foam which is expanded between the side panels 25 after the panels are assembled onto the frame members 10 and while the panels 25 are confined between rigid back-up form members or platens (not shown).

Figure 2:
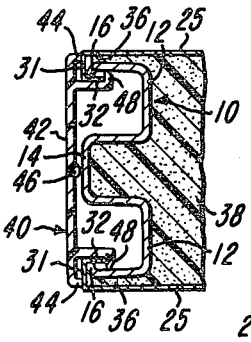
FIG. 2 is a fragmentary section taken generally on the line 2—2 of FIG. 1.
Figure 3:
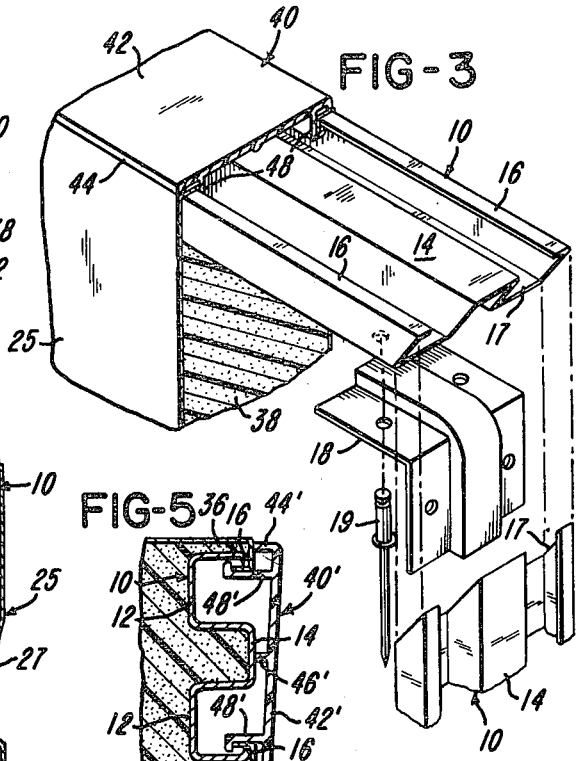
FIG. 3 is an exploded perspective view of a top corner portion of the door and illustrating the joining of the ends of the frame member.
Figure 4:
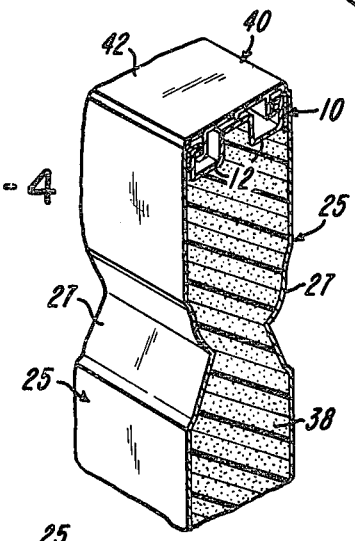
FIG. 4 is a fragmentary perspective view as would be seen on the line 4—4 of FIG. 1.

Referring to FIGS. 2–4, an elongated semi-rigid trim member 40 extends along one vertical edge of the door and across the top of the door. The trim member 40 has a width substantially equal to the spacing between the side panels 25 and is extruded from a plastics material such as a semi-rigid polyvinyl chloride. Each trim member 40 has a flat outer wall 42, and a set of integral parallel flange portions 44 project inwardly from the wall 42 to engage the corresponding inwardly formed flange portions 31 of the side panels 25. Each trim member 40 also includes an inwardly projecting longitudinally extending integral bead portion 46 which seats against the adjacent web portion 14 of the frame member 10.

A pair of integral hook-shaped leg portions 48 extend longitudinally of the trim member and project into the cavities formed by the channel portions 12 of the adjacent frame member 10. The leg portions 48 also project outwardly under the inner ends of the inwardly projecting tab portions 32 of the side panels 25. The outer wall 42 of each of the trim members 40 is flexed or bowed outwardly to a slightly curved configuration by pinching the flange portions 44 for inserting the leg portions 48 into the channel portions 12 of the adjacent frame member 10. When the outer wall 42 is released, the leg portions 48 snap outwardly under the tab portions 32 (FIGS. 2 and 3), to form a positive rigid connection of the trim member 40 to the frame member 10.

Figure 5:
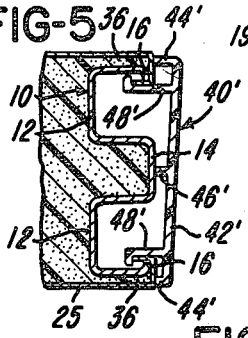
FIG. 5 is a fragmentary section taken generally on the line 5—5 of FIG. 1.

Another elongated trim member 40′ (FIGS. 5 and 8) extends along the opposite vertical edge of the door and covers the corresponding frame member 10. The trim member 40′ is constructed substantially the same as the trim member 40 and thus the corresponding portions of the trim member are identified with like reference number with the addition of a prime mark. The main difference between the trim member 40′ and the trim member 40 is shown in FIG. 5. That is, the outer wall 42′ tapers at a slight angle of approximately 3° relative to a reference plane normal to the side panels 25. This slight angle or taper provides a beveled outer edge surface for the outer edge of the door and minimizes the width of the gap defined between this edge of the door and the adjacent door jamb.

Figure 6:
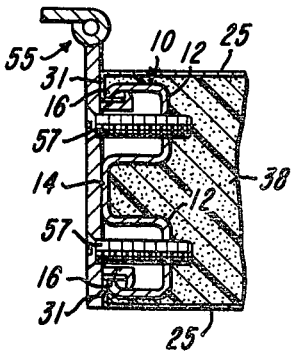
FIG. 6 is another fragmentary section taken generally on the line 6—6 of FIG. 1.

Referring to FIG. 6, a set of metal hinges 55 include plates 56 which are mounted on the opposite or inner edge of the door and are secured to the adjacent frame member 10 by a set of screws 57 which thread into holes formed within the channel portions 12 of the frame member. The hinge plates 56 seat on the outer flange portions 31 of the side panels 5 and the web portion 14 of the adjacent frame member 10, and the trim strip 40 is notched or interrupted for each of the hinges 55. Preferably, the flanges 44 of the trim strip 40 have a thickness which is equal to the thickness of the attached hinge plate 56 so that the outer surface of each hinge plate is substantially flush with the outer surface of the wall 42 of the trim member 40.

Figure 8:
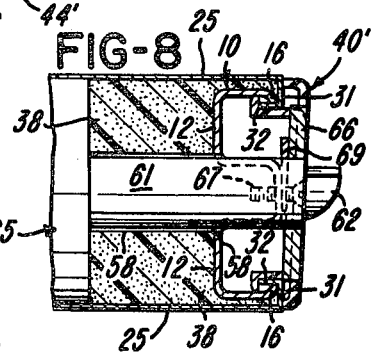
FIG. 8 is a fragmentary section similar to FIG. 5 and taken generally on the line 8—8 of FIG. 1.

Referring to FIG. 8, a circular bore 58 is formed within the web portion 14 of the frame member 10 along the outer edge of the door and within the insulation material 38 for receiving a tubular housing 61 which supports a latch bolt 62 projecting from a conventional door lock assembly 65. The latch bolt housing 61 includes a mounting flange 66 which is secured to the web portion 14 of the adjacent frame member 10 by a set of screws 67 positioned above and below the latch bolt 62 and threaded into the web portion 14. If desired, the mounting flange 66 may be tilted slightly by a tapered wedge-like shim 69 so that the outer surface of the mounting flange 66 is substantially flush with the outer tapered surface of the trim member 40′.

Figure 7:
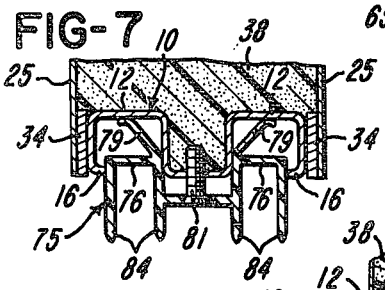
FIG. 7 is a further fragmentary section taken generally on the line 7—7 of FIG. 1 and illustrating the support of a door sweep or sealing member.
Figure 9:
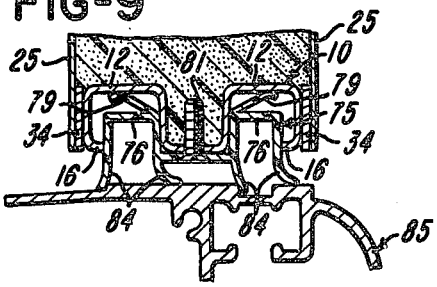
FIG. 9 is a fragmentary section similar to FIG. 7 and illustrating the seal formed by the sealing member between the bottom of the door and a door threshold.

As shown in FIGS. 7 and 9, the frame member 10 which extends along the bottom of the door, receives an elongated door sweep or sealing member 75 which is preferably formed as a dual durometer extrusion of a plastics material such as polyvinyl chloride. The sealing member 75 includes a pair of parallel spaced inverted U-shaped channel portions 76 which interfit into the corresponding channel portions 12 of the frame member 10 and are integrally connected by a flat bottom web portion 77. A set of spring-like longitudinally extending flanges 79 are extruded as an integral part of the sealing member 75 and are inclined upwardly to engage the channel portions 12 of the bottom frame member 10. The flanges 79 urge the sealing member 75 downwardly against the heads of a series of spaced retaining screws 81 which are threaded upwardly into holes formed within the web portion 14 of the bottom frame member 10.

A set of longitudinally extending lips 84 project downwardly from the channel portions 76 of the sealing member 75. The longitudinally extending lips 84 are extruded as an integral part of the sealing member 75 but are formed of a flexible vinyl material as compared with the semi-rigid vinyl material forming the remaining portion of the sealing member 75. As shown in FIG. 9, the sealing member 75 is positioned relative to the bottom of the door by adjusting the screws 81 so that when the door is closed, the sealing lips 84 engage the top surface of a threshold 85 which is secured to the floor at the bottom of the doorway. To adjust the position of the sealing member 75 relative to the threshold 85, the door is removed from the hinges 55 in order to have convenient access to the screws 81.

Figure 10:
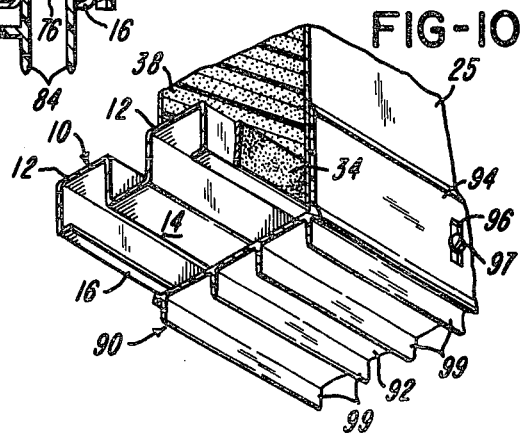
FIG. 10 is a fragmentary perspective view of a bottom portion of a door assembly and showing a modified form of a door sweep or sealing member.

In some installations where it is not convenient to remove the door from the hinges 55, a channel-like door sweep or sealing member 90 (FIG. 10) is attached to the bottom frame member 10 of the door in place of the sealing member 75. The sealing member 90 is also formed of extruded plastics material and includes a substantially flat bottom wall 92 which integrally connects a pair of upwardly projecting side walls or flanges 94. The flanges 94 engage the outer surfaces of the side panels 25 and have a series of longitudinally spaced vertical slots 96 which receive corresponding screws 97 for securing the sealing member 90 to the bottom frame member 10 of the door.

A series of longitudinally extending sealing lips 99 are extruded as an integral part of the sealing member 90, but are formed of a flexible plastics material in the same manner as the sealing lips 84 described above in connection with FIGS. 7 and 9. The sealing member 90 is positioned relative to the door threshold 85 simply by releasing the screws 97, adjusting the position of the sealing member 90 and then retightening the screws 97.

Figure 11:
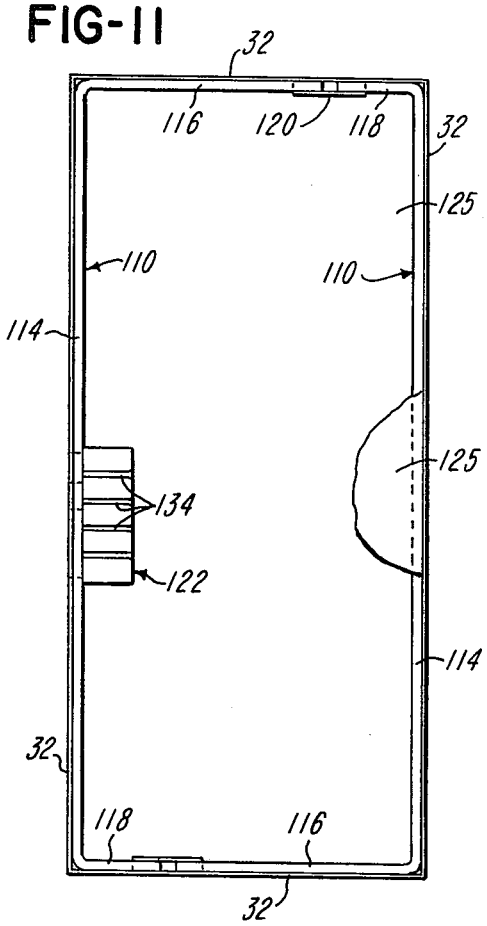
FIG. 11 is a view of the inner surface of one door side panel and showing a two-section metal frame expanded into engagement with the edge portions of the side panel.

Referring to FIGS. 11–14 which show another method of constructing a metal door in accordance with the invention, a rectangular metal frame is constructed of a pair of mating frame sections 110 each having a generally C-shaped configuration and formed by a longitudinally extending frame member 114 integrally connecting a set of laterally extending frame members 116 and 118. The cross-sectional configuration of each frame section 110 is identical to that of the frame member 10 described above in connection with FIGS. 1–10, and thus the same reference numbers are used to identify the corresponding components of each frame section. A sheet metal connector channel 120 is spot welded to the end of the laterally extending frame member 116 of each frame section 112, and after the frame sections 110 are positioned as shown in FIG. 11, the channels 120 are also welded to the corresponding opposing frame members 118.

Figure 13:
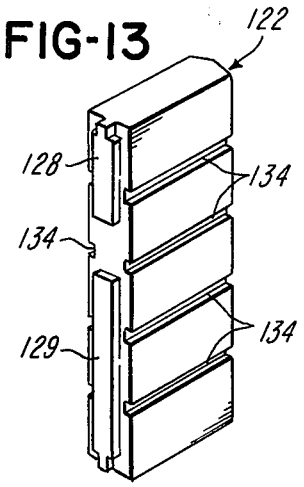
FIG. 13 is a perspective view of a rigid high density foam block which is positioned between the side panels, as illustrated in FIG. 11.

Referring to FIG. 13, a premolded block 122 of expanded rigid plastics foam material, is positioned adjacent one of the frame members 114 which corresponds to the outer latch edge of the metal door. The block 122 has a density which is substantially greater than the density of the plastics foam material 38 which is expanded between the sheet metal skins or side panels 125 of the door. For example, the density of the block 122 is on the order of 15 to 18 pounds per cubic foot, whereas the density of the expanded foam 38 is on the order of 2 pounds per cubic foot.

The block 122 includes a set of longitudinally extending integral keys or bosses 128 and 129 which project through corresponding slots formed within the adjacent frame member 114. The outer surfaces of the bosses 128 and 129 are flush with the outer surface of the web portion 14 of the frame member 114. The block 122 also includes a set of laterally extending grooves 134 in each of its side surfaces, and the grooves 134 are filled with the foam material 38 during assembly of the door. The sheet metal side panels 125 are constructed in the same manner as the side panels 25 described above, except that the integral flange portions 31 and the tab portions 32 of each panel extend around the entire periphery of the panel, including the bottom edge.

Figure 12:
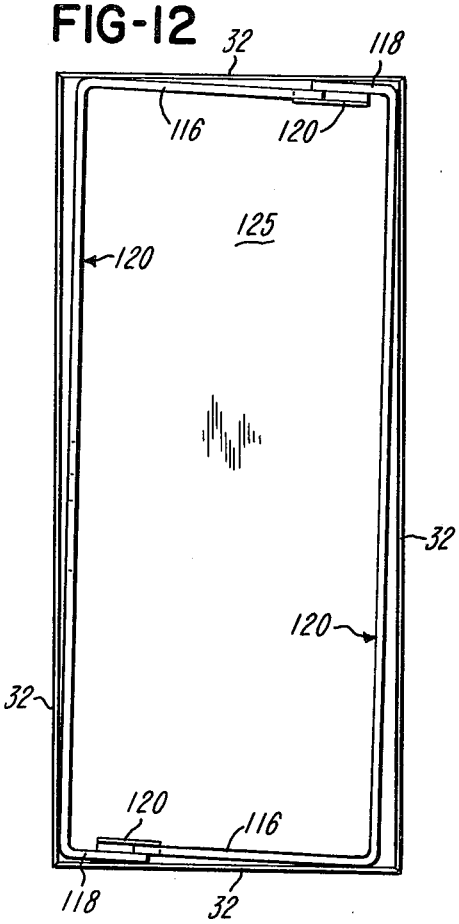

In accordance with the invention, a metal door including the frame sections 110 and side panels 125, is assembled in the following manner. One of the side panels 125 is placed on a table, and the frame sections 110 are positioned adjacent the side panel in an interfitting manner, as shown in FIG. 12. The premolded block 122 of expanded foam material, is placed on the one side panel, and the keys or bosses 128 and 129 are inserted into the corresponding slots within the adjacent frame member 114. The other side panel 125 is then placed over the frame sections 110 so that the frame sections 110 are sandwiched between the side panels 125.

The frame sections 110 are then shifted outwardly from their positions shown in FIG. 11, after which the connector channels 120 are welded to the corresponding frame members 118. When the frame sections 110 are expanded from their interfitting positions (FIG. 12) to form the rectangular frame shown in FIG. 11, the peripherally extending channel portions 12 of the frame sections 110, receive the corresponding peripherally extending and inwardly projecting lip portions 16 of the side panels 125. Thus when the frame sections 110 are welded together, the side panels 125 are locked to the rectangular frame around the entire periphery of the frame and cannot be disassembled without detaching the welded connector channels 120. This structure is highly desirable for providing a fire resistant metal door and to assure that the side panels 125 do not separate from the metal frame.

After the side panels 125 are mechanically connected by the rectangular frame sections 110, with the preformed block 122 sandwiched between the side panels, the assembly is placed within a press having parallel spaced backup platens for the side panels 125. The foam material 38 is then injected through an opening within one of the frame sections 110 and into the chamber or cavity defined between the side panels 125. As the foam insulation material expands within the cavity, the foam material also extrudes into the grooves 134 within the block 122. Thus when the expanded foam insulation material sets, it forms a positive bond between each of the side panels 125 and the preformed foam block 122 so that the side panel cannot move or flex outwardly relative to the block 122. The substantial size of the dense foam block 122 and the projecting bosses 128 and 129 provide for accommodating various types and designs of door lock sets and dead bolt sets.

Figure 14:
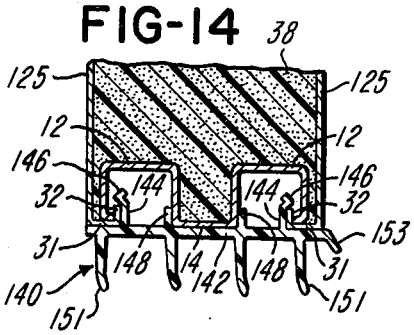
FIG. 14 is a fragmentary section similar to FIG. 7 and showing another form of door sweep or sealing member constructed in accordance with the invention.

Referring to FIG. 14, the rigidly connected bottom members 116 and 118 of the rectangular frame are adapted to receive a threshold door sweep or sealing member 140 which is extruded from a dual durometer thermoplastics material such as the sealing members 75 and 90 described above in connection with FIGS. 7 and 10. The elongated sealing member 140 includes a substantially flat base wall 142 which extends along the bottom of the metal door and has a width substantially equal to the width of the door. A pair of longitudinally extending hook-like leg portions 144 are integrally connected by the base wall 142 and project upwardly into the corresponding channel portions 12 of the bottom frame member. Each of the leg portions 144 includes an outwardly projecting rib portion 146 which snaps over the upper edge of the upwardly projecting tab portion 32 of the corresponding side panel 125 so that the sealing member 140 snap-fits into engagement with the bottom edge portion of a door in the same manner as the trim member 40 and 40' snap-fit into engagement with the vertical and upper edge portions of the door.

A pair of longitudinally extending ribs 148 are formed as an integral part of the sealing member 140 and project upwardly on opposite sides of the center web portion 14 of the bottom frame member. The ribs 148 cooperate with the leg portions 144 to prevent lateral shifting of the sealing member 140 relative to the bottom edge surface of the door during opening and closing of the door. The sealing member 140 also includes a plurality of longitudinally extending and downwardly projecting flexible sealing lips 151 which are integrally connected by the relatively rigid base wall 142. The flexible sealing lips 151 are adapted to engage a threshold in a manner similar to the engagement of the sealing lips 84 or 99 with the threshold 85, as described above in connection with FIGS. 9 and 10. The sealing member 140 also includes a longitudinally extending drip lip 153 which is formed as an integral part of the base wall 142 and slopes downwardly adjacent the bottom edge of the outer side panel 125.

Figure 15:
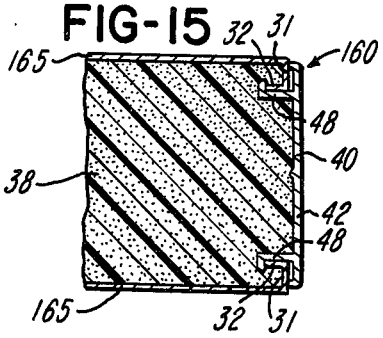
FIG. 15 is a fragmentary section similar to FIG. 2 and illustrating a metal door side panel also constructed in accordance with the invention.

As mentioned above, it is also within the scope of the invention to form a metal door side or border panel assembly 160 (FIG. 15) which may be used adjacent the metal door shown in FIG. 1, but which is fixed in position and is not supported by hinges for pivotal movement. The border panel assembly 160 includes a pair of sheet metal side panels 165 which are constructed in the same manner as the side panels 125 but have approximately one-half of the width of the side panels 125. The side panels 165 are preferably provided with a single vertical row of rectangular embossments or impressions which correspond to the impressions 27, 28 and 29 as shown in FIG. 1.

The metal border panel assembly 160 does not require a rectangular metal frame, and the side panels 165 are bonded together by the expanded foam insulation material 38 and the interfitting connection of a set of trim members 40 which extend around the entire periphery of the border panel assembly 160. In the production of a metal border panel assembly 160, a pair of sheet metal side panels 165 are positioned in parallel spaced relation, and a set of trim members 40 are snap-fitted into engagement with the side panels 165 around the periphery of the side panels. While the side panels 165 are confined between parallel spaced platens, and the trim members 40 are supported by a rigid rectangular back-up frame, the foam insulation material 38 is expanded within the chamber or cavity defined between the side panels 165 until the material fills the entire cavity including the space between the leg portions 48 of each trim member 40. When the expanded foam insulation material 38 sets, the result is a rigid border panel assembly 160 which has a smooth peripheral edge surface formed by the trim members 40 in addition to the decorative appearance of the sheet metal side panels 165.

From the drawing and the above description, it is apparent that a metal door constructed in accordance with the present invention, provides desirable features and advantages. For example, the assembly of the metal door frame members 10 or frame sections 110 and the metal side panels 25 and 125, provides a rigid construction which is not affected by changes in temperature and humidity, and the expanded foam insulation material 38 cooperates to minimize heat and sound transfer. The extension of the insulation material into the narrow spaces 36 between the side panels 25 and the door frame members 10 also provides a thermal barrier so that the frame members 10 do not conduct heat from one side panel 25 to the other side panel 25.

Another important feature is provided by the cooperation of the door frame members 10 or frame sections 110 and the trim members 40 and 40'. That is, the trim members not only provide a cover for the cavities defined by the channel portions 12 of the corresponding frame members, the trim members also provide for conveniently mounting the hinges and the flange of the latch bolt housing so that they are flush with the outer corresponding edge surfaces of the door. In addition, the trim member 40' may be conveniently reversed to provide for either a left hinging or a right hinging door. As mentioned above, the frame member along the bottom of the door, provides for positively retaining the door sweep or sealing member 75 or 140 and for adjusting the member 75 within the lower edge portion of the door so that the sealing lips 84 engage the door threshold 85 with the desired flexing as illustrated in FIG. 9.

It is also apparent that the expanding of the frame sections 110 into engagement with the inwardly projecting edge portions of the side panels 125, provides for positively retaining each side panel around the entire periphery of the door without requiring an adhesive. In addition, the dense foam block 122 provides for conveniently mounting a door lock set and, if desired, a dead-bolt lock set since the block 122 is effective to retain the mounting screws.

While the forms of door assemblies herein described constitute preferred embodiments of the invention, it is to be understood that the invention is not limited to these precise forms of door assemblies, and that changes may be made therein without departing from the scope and spirit of the invention as defined in the appended claims.

The invention having thus been described, the following is claimed:

1. An improved metal door or panel assembly comprising a rigid metal rectangular frame including a set of opposing generally C-shaped frame sections each having a longitudinally extending frame member integrally connecting parallel spaced laterally extending frame members, means for rigidly connecting said frame sections to form said frame, a set of generally rectangular sheet metal side panels each having outer peripherally extending edge portions, a thermal insulation material disposed within said frame between said side panels, and means for connecting said edge portions of said side panels to said frame members around said frame for restricting outward movement of said frame members, and said side panels.

2. A door or panel as defined in claim 1 wherein one of said laterally extending frame members of each said frame section is substantially longer than the other said laterally extending frame member of said frame section to facilitate assembly of said frame sections.

3. An improved metal door or panel assembly comprising a rigid metal rectangular frame including a set of opposing frame sections each having a longitudinally extending metal frame member integrally connected to a laterally extending metal frame member, said frame members having channel-shaped portions defining outwardly facing corresponding cavities extending substantially around the entire outer periphery of said frame, a set of generally rectangular sheet metal side panels each having inwardly formed outer edge portions extending substantially around the entire outer periphery of said panel and projecting inwardly into corresponding said cavities of said frame members, a thermal insulation material disposed within said frame between said side panels, said edge portions of said side panels confining said frame members substantially completely around said frame and restricting said frame members from outward movement, said channel-shaped portions of said frame members confining said edge portions of said side panels substantially completely around said frame and restricting said side panels from separating, and means providing for expanding of said frame sections outwardly into said edge portions of said side panels during assembly.

4. An improved metal door or panel assembly comprising a rigid metal rectangular frame including a set of longitudinally extending parallel metal frame members and a set of laterally extending parallel metal frame members, each of said frame members having a set of parallel spaced channel portions defining outwardly facing corresponding cavities, said corresponding cavities of said frame members extending substantially around the entire outer periphery of said frame, a set of generally rectangular sheet metal side panels each having inwardly formed outer edge portions extending substantially around the entire outer periphery of said frame members, a thermal insulation material disposed within said frame between said side panels, said edge portions of said side panels confining said frame members around substantially the entire said frame and restricting said frame members from outward movement, said channel portions of said frame members confining said edge portions of said side panels around substantially the entire said frame and restricting said side panels from separating, and means providing for expanding of said frame members outwardly into said edge portions of said side panels during assembly.

5. A metal door or panel assembly as defined in claim 4 wherein said channel portions of each said frame member are integrally connected by a substantially flat web portion extending generally flush with the corresponding said outer edge portions of said side panels.

6. An improved metal door or panel assembly comprising a rigid rectangular frame including longitudinally extending parallel frame members and laterally extending parallel frame members, said frame members having channel portions defining outwardly facing corresponding cavities extending substantially around the entire outer periphery of said frame, a set of generally rectangular sheet metal side panels each having inwardly formed outer edge portions extending substantially around the entire outer periphery of said panel and projecting inwardly into corresponding said cavities of said frame members, a thermal insulation material disposed within said frame between said side panels, said edge portions of said side panels confining said frame members around substantially the entire said frame and restricting said frame members from outward movement, said channel portions of said frame members confining said edge portions of said side panels around substantially the entire said frame and restricting said side panels from separating, and means providing for expanding of said frame members outwardly into said edge portions of said side panels during assembly.

7. A door assembly as defined in claim 6 wherein said insulation material comprises a panel of expanded substantially rigid foam material having a predetermined density, a preformed block of expanded substantially rigid foam material disposed within said panel of foam material adjacent one of said longitudinally extending frame members, said block of foam material has a density substantially greater than said density of said panel of foam material, and means defining at least one recess within said preformed block adjacent one of said side panels for receiving the lower density said foam material.

8. A door assembly as defined in claim 6 wherein said insulation material comprises an expanded substantially rigid foam material urging said frame members outwardly against said edge portions of said side panels.

9. A door assembly as defined in claim 6 including a set of elongated trim members extending adjacent corresponding said frame members and covering said cavities, and each of said trim members includes a set of longitudinally extending and integrally connected hook-like leg portions engaging the corresponding edge portions of said side panels for retaining said trim member.

10. A door assembly as defined in claim 6, including an elongated bottom sealing member having a substantially flat base wall extending adjacent the lower said edge portions of said side panels, and a plurality of longitudinally extending parallel spaced leg portions projecting upwardly from said base wall into corresponding said cavities and over corresponding said edge portions of said side panels.

11. A door assembly as defined in claim 6 including an elongated door seal having a substantially flat base wall extending adjacent the lower said edge portions of said side panels, a plurality of longitudinally extending flexible sealing lips projecting downwardly from said base wall and integrally connected thereby, a set of longitudinally extending flanges projecting upwardly from said base wall adjacent said side panels, and means for adjustably securing at least one of said flanges to the adjacent said side panel.

12. A method of producing a metal door assembly comprising the steps of forming a set of generally rectangular sheet metal side panels each having peripherally extending outer flange portions integrally connected to corresponding peripherally extending inwardly projecting return tab portions, forming a set of rectangular frame sections defining peripherally extending and outwardly facing cavities, positioning said frame sections between said side panels disposed in parallel relation, expanding said frame sections between said side panels causing said tab portions to project into said cavities, expanding a foam insulation material between said side panels and within said frame sections, extruding a plastics material to form a set of trim members each including a pair of generally parallel and longitudinally extending hook-like leg portions, and inserting said leg portions into corresponding said cavities within said frame sections and under the corresponding said tab portions of said side panels for securing said trim members to said side panels and for covering said cavities with said trim members.

13. A method of producing a metal door or panel assembly comprising the steps of forming a set of generally rectangular sheet metal side panels each having longitudinally extending opposite edge portions and laterally extending opposite edge portions, bending each said edge portion of each said side panel to form an inwardly projecting corresponding return tab portion, forming a rectangular frame with frame sections having outwardly facing cavities extending substantially around the entire periphery of said frame, positioning said frame sections between said side panels disposed in parallel relation, expanding said frame sections outwardly between said side panels causing said tab portions to project into corresponding said cavities of said frame sections around substantially the entire periphery of said frame, and inserting a foam insulation material between said side panels and within said frame.

14. A method as defined in claim 13 wherein each of said frame sections is formed by roll-forming a flat strip of metal to form channel portions defining said cavities, and bending the roll formed strip to produce corresponding corners of said frame sections.

15. A method as defined in claim 13 wherein each of said frame sections is formed with a longitudinally extending frame member integrally connecting a set of laterally extending frame members, and forming one of said laterally extending frame members of each said frame section with a length substantially greater than the length of the other laterally extending frame member of said frame section.

16. A method as defined in claim 13 including the step of preforming a block of expanded foam insulation material having a density substantially greater than the insulation material expanded between the side panels, and inserting said block between said side panels and adjacent one of said frame sections prior to expanding the foam insulation material between the side panels.

17. A method as defined in claim 16 including the step of forming a plurality of grooves in said block of insulation material for receiving the insulation material expanded between the side panels and to effect bonding of the block with the side panels.

* * * * *